United States Patent [19]

Paddock

[11] Patent Number: 4,889,513

[45] Date of Patent: Dec. 26, 1989

[54] TOY RACE CAR LAUNCHER

[75] Inventor: Charles W. Paddock, East Aurora, N.Y.

[73] Assignee: The Quaker Oats Company, Chicago, Ill.

[21] Appl. No.: 255,366

[22] Filed: Oct. 11, 1988

[51] Int. Cl.[4] ..... A63H 18/00

[52] U.S. Cl. ..... 446/197; 446/429; 124/61

[58] Field of Search ..... 446/197, 180, 429, 430, 446/63, 168; 273/86 C, 86 D; 124/61, 63, 64

[56] References Cited

U.S. PATENT DOCUMENTS

| | | | |
|---|---|---|---|
| 1,252,616 | 1/1918 | Reif | 446/168 X |
| 3,548,534 | 12/1970 | Beny et al. | 446/430 |
| 3,600,850 | 8/1971 | Summerfield | 273/86 D X |
| 4,249,733 | 2/1981 | Eddins et al. | 273/86 C |
| 4,534,745 | 8/1985 | Jones et al. | 446/429 X |
| 4,541,813 | 9/1985 | Ikeda | 446/429 |
| 4,605,230 | 8/1986 | Halford et al. | 446/429 X |

FOREIGN PATENT DOCUMENTS

| | | | |
|---|---|---|---|
| 500834 | 3/1954 | Canada | 446/429 |

*Primary Examiner*—Mickey Yu

*Attorney, Agent, or Firm*—Cumpston & Shaw

[57] ABSTRACT

A toy race car launcher is disclosed comprising a launcher body, a car support track on the launcher body, and a car disabling mechanism on the car support track for positioning the car in rest position at a car launching position. A car launching mechanism is provided on the launcher body at the car launching position for launching the car from the car support track.

7 Claims, 3 Drawing Sheets

TOY RACE CAR LAUNCHER

FIELD OF THE INVENTION

The present invention relates generally to toy race cars rideable on a track, and more specifically to a toy race car launcher for launching a race car from a car support track.

1. Background of the Invention:

Toy race cars rideable on a car support surface, such as a track, are well-known in the art. There has been a constant search for years for toy race car applications that can produce a new, more entertaining, or more interesting application. This invention is a realization of an attempt to make the launching action of a toy race car from a car support track more entertaining and interesting to children.

2. Summary of the Invention

An object of this invention is to provide a toy race car launcher comprising:

a launcher body;

a car support track on the launcher body;

car disabling means on the car support track for positioning a car at rest in a car launching position; and car launching means on the launcher body at the car launching position for launching the car from the car support track.

Another object of the invention is to provide a toy race car launcher wherein the car has at least one drive wheel, wherein the support track is inclined upwardly from a horizontal plane, and wherein the car disabling means comprises recesses in the track for receiving and disengaging the drive wheels from the track.

Still another object of the invention is to provide a toy race car launcher wherein the car has at least one tooth on the bottom thereof, wherein the car support track has an elongated slot at the car launching station, wherein the car launching means comprises a toothed rack slidably movable within the slot, and wherein motion imparting means are provided coupled to the toothed rack for imparting movement to the toothed rack for engaging the car tooth and launching the car from the car support track.

Another object of the invention is to provide a toy race car launcher wherein the car launching means comprises a flexible strip having the toothed rack at one end thereof, and wherein the motion imparting means comprises a movable pivotal member secured to the opposite end of the flexible strip, and pneumatic moving means for moving the pivotal member, causing the strip and toothed rack thereon to move therewith for launching the car.

In still another object of the invention, the movable member of the toy race car launcher comprises a pivotally mounted segment having a circular surface of a fixed radius over which the flexible strip is trained, wherein the moving means comprises a first flexible bellows having a normal deflated condition and a fixed end, and wherein coupling means are provided for coupling the other movable end of the first bellows to the segment for moving the segment upon expansion of the bellows from its normal deflated position.

Still another object of the present invention is to provide a toy race car launcher in which the car support track has an entry end and an exit end, and the track is provided with adjustable means at the exit end for varying the path of trajectory of the launched car.

BRIEF DESCRIPTION OF THE DRAWINGS

In the detailed description of the invention presented below, reference is made to the accompanying drawings, in which.

DETAILED DESCRIPTION OF THE PREFERRED EMBODIMENT

Because toy race cars and support tracks therefor are well-known, the present description will be directed in particular to elements forming part of, or cooperating directly with, a toy race car launcher, in accordance with the present invention. It is to be understood that elements not specifically shown or described may take various forms well-known to those skilled in the art.

Figure 1:
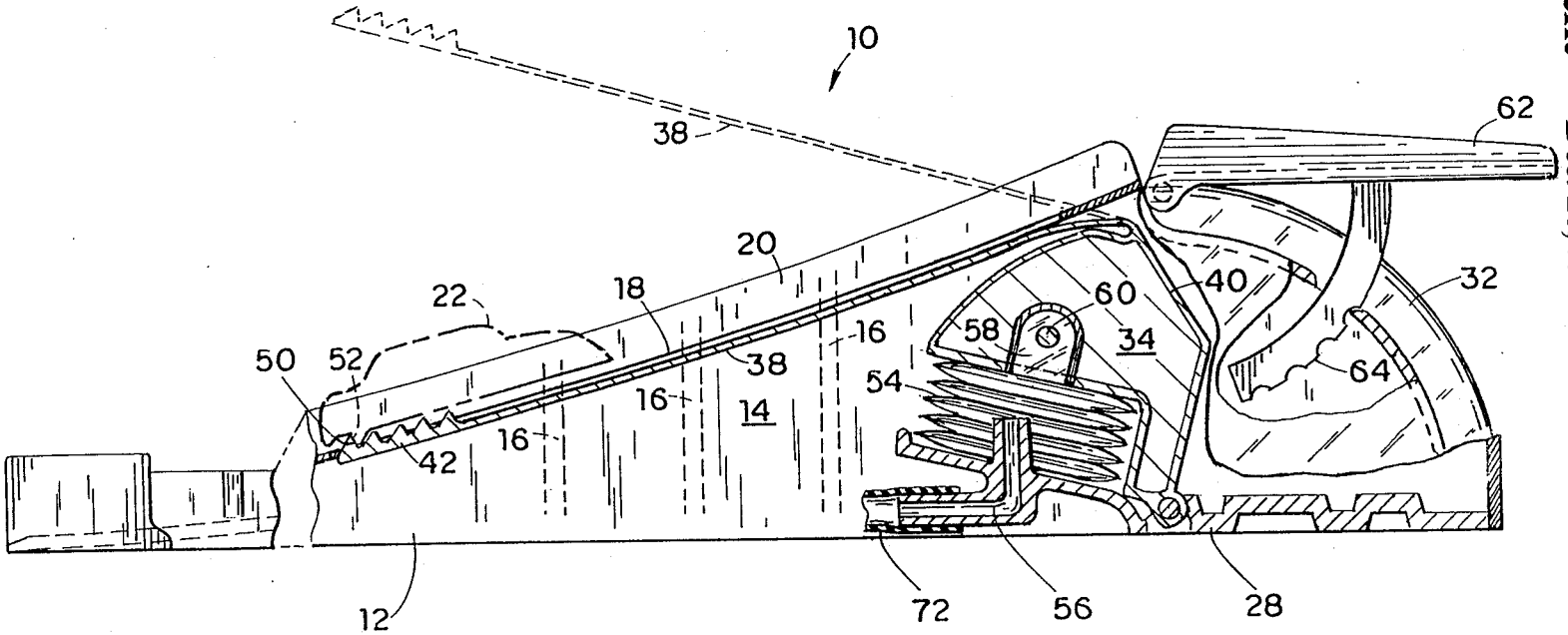
FIG. 1 is a side-elevational view of a preferred embodiment of a toy race car launcher of this invention, with portions thereof broken away to better show the invention.
Figure 2:
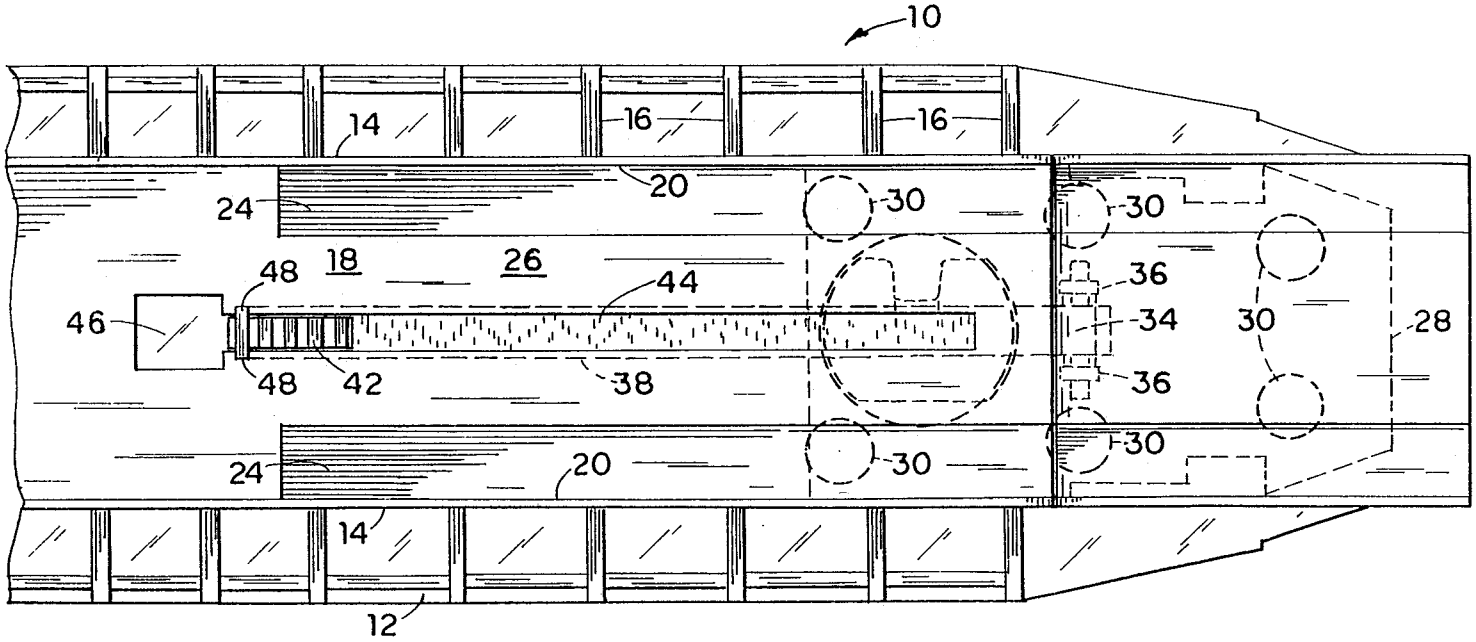
FIG. 2 is a top plan view of the car launcher of FIG. 1.
Figure 3:
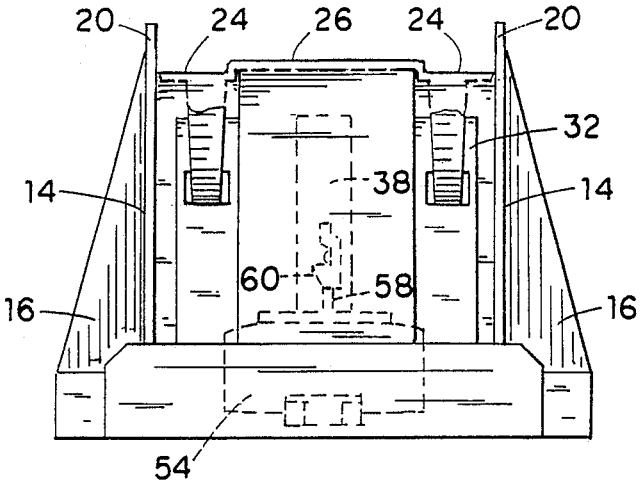
FIG. 3 is a rear end view of the car launcher of FIG. 1.
Figure 4:
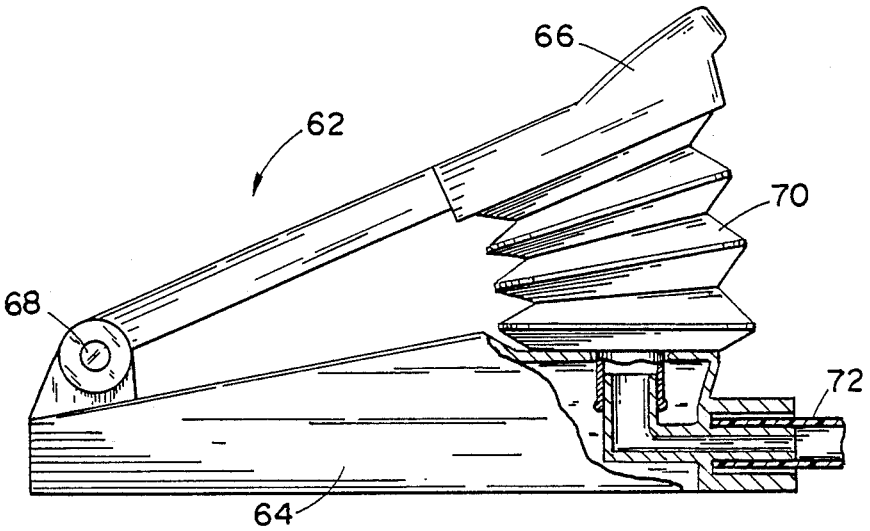
FIG. 4 is a side-elevational view of a hand operated pneumatic pump for actuating the toy race car launcher.

Referring to FIGS. 1–3, a preferred embodiment of a toy race car launcher 10 is disclosed comprising a unitary launcher body 12 formed by any suitable molding process or the like. The launcher body has spaced side walls 14 having ribs 16 thereon for ornamental and rigidifying purposes. The launcher body 12 has a curved top plate forming a car support track 18. The upper ends of the side walls 14 extend above top plate 18 to form guide rails 20 for guiding a toy race car 22 in to and over the car support track 18.

A car disabling means is provided on the car support track 18 for disabling a car 22 so that it will be in a rest position at the car launching position. The car disabling means comprises a pair of elongated recesses 24 in the car support track 18 adjacent the guide rails 20. The recesses 24 are of a sufficient depth so that the undersurface of the car body will rest on the upper surface of the portion 26 of the car support track 18 interposed between the recesses. In this rest position, the car drive wheels are disengaged from the car support track 18, and will spin without traction, so that the car will remain at rest in the car launching position.

A car launching means is provided for launching the car from its rest position at the car launching position on the car support track 18. The car launching means comprises a flat V-shaped support plate 28 that is secured underneath support track 18 by conventional means to posts 30 depending from the support track and a curved rear wall 32 on the launcher body 12. The launcher body side walls 14 and top plate 18 form a cavity within which the car launching means is mounted on the support plate 28. The car launching means further comprises a movable pivotal segment member 34 having one end thereof pivotally supported on support plate 28 between spaced tabs 36. (FIG. 2.) One end of a flexible strip 38 is secured to a flat surface 40 on the movable segment member 34, and a toothed rack 42 is mounted on the opposite end of the strip. The top plate 18 forming the car support track has an elongated slot 44 extending therethrough, having an enlarged opening 46 at one end thereof. The tip of the toothed rack 42 is inserted into the enlarged opening 46, and movement of the rack along the slot causes laterally extending pins 48 on the end thereof to engage the upper surface of the car support track 18 for capturing the toothed rack 42 for slidable movement in the slot 44. The normal resilience of the strip 38 urges the toothed rack 42 into the slot. Pivotal movement of the segment 34 in a clockwise direction causes the intermediate portion of the strip 38 to follow the curved trace and the toothed rack 42 to move along the slot, causing a tooth 50 thereon to engage a corresponding tooth 52 on the bottom surface of the car 22 for launching or catapulting the car from the car support track.

The pneumatic means for imparting motion to the pivotal segment comprises a flexible first bellows 54, having a central collar at one end thereof extending over one end of a sleeve 56. An opposite closed end of the bellows has a tab 58 with an opening extending therethrough for receiving a lug 60 laterally extending from a notched portion in the segment member 34. The bellows 54 has a normal deflated condition for moving the segment member 34 to its maximum counter-clockwise position, as seen in FIG. 1, for positioning the toothed rack 42 adjacent the enlarged opening 46 of the slot. Upon sudden expansion of the bellows 54, the segment member 34 is rapidly pivoted in a clockwise direction causing the toothed rack 42 to engage the tooth 52 on the undersurface of the car and to propel or catapult the car from the car support track 18 over an adjustable end section 62 having a curved toothed rack 64 engaging an opening in curved rear wall 32, for varying the path of trajectory of the launched car.

The pneumatic means for suddenly inflating the first bellows 54 comprises any suitable hand operated pump 62 or the like for rapidly introducing air into the first bellows and then discharging the air therefrom. The hand pump 62 comprises a base 64, a hand member 66 pivotally secured on a pivot 68 at one end of the base, and a second bellows 70 interposed between the hand member 66 and base 64. A tube 72 (FIG. 1) connects sleeve 56 to a tube 72 on the base for fluidly connecting the first and second bellows 54, 70, so that sudden compression of the second bellows causes expansion of the first bellows 54 and forward movement of the toothed rack 42 for catapulting a car.

While a preferred embodiment of the invention has been shown and described with particularity, it will be appreciated that various changes and modificiations may suggest themselves to one having ordinary skill in the art upon being apprised of the present invention. It is intended to encompass all such changes and modifications as fall within the scope and spirit of the appended claims.

What is claimed is:

1. A toy race car launcher for a car having at least one drive wheel and at least one tooth on the bottom thereof comprising:

a launcher body;

an upwardly inclined car support track on the launcher body having an elongated slot at the car launching station;

a recess in the track for receiving and disengaging the drive wheel from the track and stopping a moving car in a car launching position;

a remotely actuable flexible strip having a toothed rack at one end thereof slidably movable within the slot for movement from the car launching position, and a movable member secured to the opposite end of the flexible strip; and moving means for moving the movable member, for imparting movement to the toothed rack for engaging the car tooth and causing the strip and tooth rack thereon to move therewith for launching the car from the car support track.

2. A toy race car launcher according to claim 1 wherein the movable member comprises a pivotally mounted segment having a circular surface of a fixed radius over which the flexible strip is trained, wherein the moving means comprises a first flexible bellows having a normal deflated condition and a fixed end, and wherein coupling means are provided for coupling the other end of the first bellows to the segment for moving the segment upon expansion of the bellows from its normal deflated condition.

3. A toy race car launcher according to claim 2 wherein the coupling means comprises a notch in the segment, a lug extending laterally from the notch, and a tab on the other end of the first bellows having an opening for receiving the lug.

4. A toy race car launcher according to claim 3 wherein the moving means further comprises a second flexible bellows pneumatically connected to the first flexible bellows, and manually operated means for compressing the second bellows and simultaneously expanding the first bellows from its normal deflated condition.

5. A toy race car launcher according to claim 4 wherein the manually operated means comprises a depressible handle.

6. A toy race car launcher according to claim 1 wherein the car support track has an entry end and an exit end, and the track is provided with adjustable means at the exit end for varying the path of trajectory of the launched car.

7. A toy race car launcher according to claim 6 wherein the adjustable means comprises a track portion having one end thereof pivotally secured to the exit end of the car support track, at least one depending arm of a substantially constant radius relative to the one end, teeth on one surface of the arm, and a lip on the launcher body selectively engageable with one of the teeth upon pivotal movement of the track portion for releasably holding the track portion in a selected position.

* * * * *